US008080745B2

(12) United States Patent
Smith

(10) Patent No.: US 8,080,745 B2
(45) Date of Patent: Dec. 20, 2011

(54) PORTABLE AUXILIARY VEHICLE WINDOW CONTROL UNITS

(75) Inventor: Timothy L Smith, Louisville, KY (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 396 days.

(21) Appl. No.: 12/341,365

(22) Filed: Dec. 22, 2008

(65) Prior Publication Data

US 2010/0155213 A1 Jun. 24, 2010

(51) Int. Cl.
*H01R 3/00* (2006.01)

(52) U.S. Cl. ..... 200/18

(58) Field of Classification Search ..... 200/18, 200/51.04, 51.05; 340/644, 648, 546; 296/146.4
See application file for complete search history.

(56) References Cited

U.S. PATENT DOCUMENTS

2010/0313477 A1* 12/2010 McKee et al. ..... 49/28
* cited by examiner

*Primary Examiner* — Vanessa Girardi
(74) *Attorney, Agent, or Firm* — Dinsmore & Shohl LLP

(57) ABSTRACT

Disclosed is a portable control unit for activating a panel assembly of a vehicle that includes a housing, a first switch disposed on the housing, at least one connector, and a battery, wherein the at least one connector is configured to engage a receptor of a panel assembly of a vehicle, the panel assembly lacking a power source, such that the battery provides power to the panel assembly and the first switch controls movement of a panel within the panel assembly.

20 Claims, 2 Drawing Sheets

PORTABLE AUXILIARY VEHICLE WINDOW CONTROL UNITS

TECHNICAL FIELD

The invention relates to portable devices utilized in controlling panel assemblies on vehicles, and more specifically, to portable devices utilized in controlling electric vehicle moonroofs and/or windows before installation of a vehicle power source.

BACKGROUND

In vehicle assembly line manufacturing processes, vehicles must sometimes be assembled in a manner that necessitates inefficiently performing a particular step of the process multiple times. In ameliorating such inefficiencies, process step rearrangement is not always a viable option because of the large amount of time and costs involved. Accordingly, devices and methods are continually sought to improve the efficiency of existing assembly line manufacturing processes, without rearranging the order of the process steps.

SUMMARY

One embodiment of a portable control unit for activating a panel assembly of a vehicle includes a housing, a first switch disposed on the housing, at least one connector, and a battery, wherein the at least one connector is configured to engage a receptor of a panel assembly of a vehicle, the panel assembly lacking a power source, such that the battery provides power to the panel assembly and the first switch controls movement of a panel within the panel assembly.

Another embodiment of a portable control unit for activating at least one of an electric moonroof and an electric window includes a housing, a first switch disposed on the housing, at least one connector, at least one battery, and at least one wire connecting the at least one connector to the at least one battery, wherein the at least one connector is capable of connecting the portable control unit to at least one of an electric moonroof motor and an electric window motor in a vehicle lacking a power source, such that the at least one battery provides power to the at least one of an electric moonroof motor and an electric window motor, and the first switch controls the at least one of an electric moonroof motor and an electric window motor.

Another embodiment of a portable control unit for opening and closing at least one of an electric moonroof and an electric window includes a housing, a trigger switch and a second switch disposed on the housing, at least one connector, at least one battery, and at least one wire connecting the at least one connector to the at least one battery. The at least one connector is capable of connecting the portable control unit to at least one of an electric moonroof motor and an electric window motor in a vehicle lacking a power source, such that the at least one battery provides power to the at least one of an electric moonroof motor and an electric window motor, the trigger switch controls the at least one of an electric moonroof motor and an electric window motor, and the at least one of an electric moonroof motor and an electric window motor drives at least one of a moonroof and a window. The second switch toggles between a first orientation and a second orientation to control the function of the trigger switch, wherein when the second switch is in a first orientation, activating the trigger switch controls the at least one of an electric moonroof motor and an electric window motor to drive the at least one of a moonroof and a window in a first direction, and when the second switch is in a second orientation, activating the trigger switch controls the at least one of an electric moonroof motor and an electric window motor to drive the at least one of a moonroof and a window in a second direction.

These and additional features can be more fully understood in view of the following detailed description, in conjunction with the drawings.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION

Figure 1:
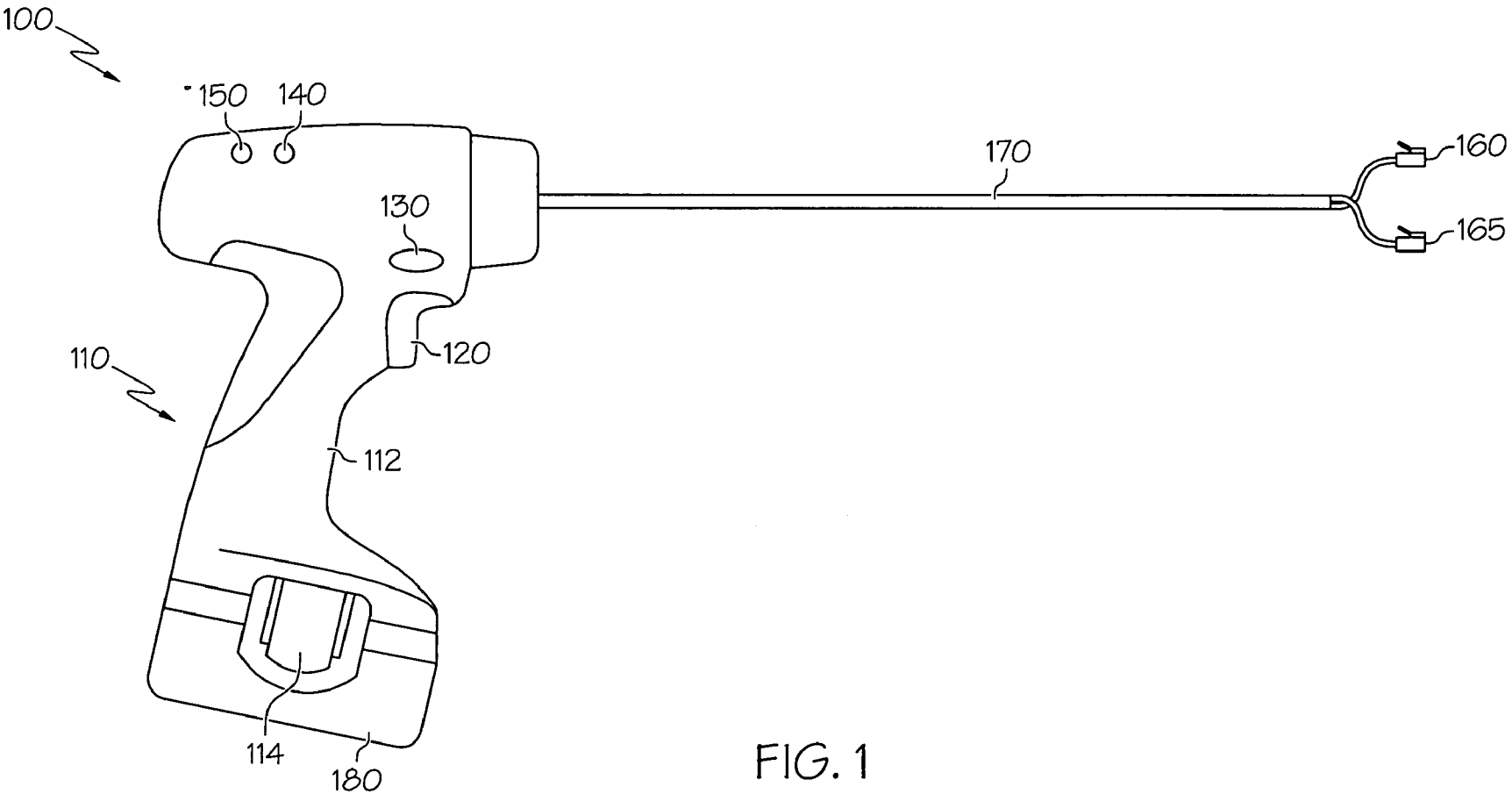
FIG. 1 is a side view of an exemplary portable control unit according to one embodiment of the present invention.

In vehicle assembly line manufacturing processes, a power source is often installed on a vehicle during the final line of assembly. Workparts installed before the final line of assembly, such as electric moonroofs and windows, therefore are inoperable throughout most of the assembly process. Because paint defects may be inaccessible due to a closed, non-operational moonroof or window in a first visit to an assembly line paint repair shop, the paint repair shop may be required to remedy paint defects on a vehicle multiple times. The portable control units described herein allow for the opening and/or closing of a vehicle moonroof and/or window before the installation of the vehicle power source (e.g., battery). The ability to operate a moonroof and/or window at any location in a manufacturing plant reduces the amount of repeated manufacturing steps, such as visits to the paint repair shop.

As will be discussed in relation to the figures, embodiments of portable control unit 100 may include a housing 110, a first switch 120 disposed on housing 110, at least one connector 160,165, and a battery 180. It should be understood, however, that embodiments of portable control unit 100 may further include additional structure, such as, for example, a second switch 130, a third switch 140 and/or a fourth switch 150.

Referring to FIG. 1, housing 110 of portable control unit 100 may be any housing on which at least one switch is disposed. Housing 110 of portable control unit 100 may be hand-held. As illustrated in FIG. 1, housing 110 may include gripping area 112. Disposed on the upper front portion of gripping area 112 is first switch 120, which comprises a trigger switch in the exemplary embodiment. Housing 110 of the that embodiment also includes second switch 130, third switch 140 and fourth switch 150, all of which will be described in greater detail below. However, any housing on which at least one switch is disposed may be utilized in embodiments of portable control unit 100. Accordingly, housing 110 may be of any shape, configuration and/or portable size, and need not include more than one switch.

Still referring to FIG. 1, first switch 120 may be any switch disposed on housing 110 utilized to control movement of a panel within a panel assembly of a vehicle. More specifically, first switch 120 may be utilized to control a motor of a panel assembly that drives a panel in various directions. Panel assembly is herein defined to include, but is not limited to, electric moonroofs and electric windows. Accordingly, in embodiments of portable control unit 100, first switch 120 may be utilized to control an electric moonroof motor (not shown) and/or an electric window motor (not shown). As mentioned above, FIG. 1 illustrates first switch 120 that comprises a trigger switch. A user may therefore grasp gripping area 112 of housing 110 with their hand and utilize their index finger to activate first switch 120. In certain embodiments, activating first switch 120 may control an electric moonroof motor and/or electric window motor to drive a moonroof and/or window in at least one direction. Depending on the application, the moonroof and/or window may be driven forward, backward, up and/or down (e.g., opened, closed, tilted up and/or tilted down). Additionally, first switch 120 need not be a trigger switch, as any switch known in the art will suffice. Non-limiting examples of alternate applicable switches include toggle switches, momentary push-button switches, selector switches and joystick switches.

At least one connector 160,165 may be utilized to connect portable control unit 100 to a panel assembly of a vehicle, wherein the connector(s) is/are configured to engage a receptor of the panel assembly. Receptor may be any structure on or connected to a panel assembly that cooperates with connector 160,165 to electrically link the panel assembly and the connector. The illustrated embodiment of portable control unit 100 includes two ten-pin connectors (as denoted in the electrical schematic of FIG. 2). A panel assembly receptor that cooperates with at least one of those connectors would therefore contain reciprocal structure to engage with the 10 pins of the connector.

Moreover, any number and/or type of connectors known in the art may be utilized to connect portable control unit 100 to receptors of panel assemblies, depending on the particular number and/or type of the panel assembly receptor(s). Accordingly, connectors of non-illustrated embodiments may include any number of pins and/or utilize any type of pin configuration. Because the receptor of the panel assembly will attach to a connector of a vehicle wiring harness in a fully built vehicle, connector 160,165 may be identical to the connector of the vehicle wiring harness. Connector(s) 160,165 may cooperate with a receptor disposed on a panel assembly, or may cooperate with a receptor connected to wiring that is connected to a panel assembly. Additionally, embodiments of portable control unit 100 need not include more than one connector.

The utilization of two different connectors (first connector 160 and second connector 165) as in the embodiment depicted in FIG. 1, allows portable control unit 100 to be employed in at least two different vehicle applications. For example, first connector 160 may be employed to connect portable control unit 100 to a panel assembly of a first vehicle and second connector 165 may be employed to connect portable control unit 100 to a panel assembly of a second vehicle. As another example, first connector 160 may be employed to connect portable control unit 100 to an electric moonroof motor of a vehicle and second connector 165 may be employed to connect portable control unit 100 to an electric window motor of the same vehicle.

At least one wire 170 may be utilized to link connector(s) 160,165 back to battery 180. Between connector(s) 160,165 and battery 180, wire 170 may link to switches disposed on the housing. Therefore, wire 170 may provide user controlled power from battery 180 to the panel assembly. Depending on the particular embodiment, wire 170 may be flexible or rigid and may include any variety of relays and diodes. The illustrated embodiment of FIG. 1 does not show the individual relays and diodes, but such are represented in the electrical schematic of FIG. 2. Wire(s) of non-illustrated embodiments may include any number and/or combinations of relays and diodes.

At least one battery 180 is employed to provide power to a panel assembly of a vehicle that lacks a power source (i.e., a battery is not yet installed on the vehicle to provide power the panel assembly). In some embodiments, battery 180 may be rechargeable. Battery 180 may also be of any appropriate voltage, including, but not limited to, 9 volt and 12 volt voltages. The illustrated embodiment of FIG. 1 includes a detachable and rechargeable 12 volt battery that is adapted to cooperate with housing 110. By depressing securing clips 114 on the sides of battery 180, the battery is removable from housing 110, and may be plugged into a docking station to recharge. Once recharged, battery 180 may be re-connected to housing 110, again through utilization of securing clips 114. However, alternate embodiments need not include a battery that is detachable nor rechargeable, as any portable battery known is the art may be utilized.

Some embodiments of portable control unit 100 may further include second switch 130. Referring to FIG. 1, second switch 130 may be any switch disposed on the housing utilized to control the function of first switch 120. As mentioned above, the embodiment of FIG. 1 includes first switch 120 that comprises a trigger switch. That embodiment also includes second switch 130 that comprises a toggle switch to control the function of first switch 120, and toggles between a first orientation and a second orientation. When second switch 130 is in a first orientation, activation of first switch 120 (e.g., depressing the trigger switch) controls a panel of a panel assembly to move in a first direction. This first direction can be forward, backward, up and/or down. In electric moonroof and/or electric window applications, when second switch 130 is in a first orientation, activation of first switch 120 controls an electric moonroof motor and/or electric window motor to drive a moonroof and/or window in such first direction.

When second switch 130 is in a second orientation, activation of first switch 120 (e.g., depressing the trigger switch) controls a panel of a panel assembly to move in a second direction. This second direction can be forward, backward, up and/or down. In electric moonroof and/or electric window applications, when second switch 130 is in a second orientation, activation of first switch 120 controls the electric moonroof motor and/or electric window motor to drive the moonroof and/or window in such second direction. Embodiments utilizing second switch 130 may therefore be capable of opening, closing, tilting up and/or tilting down an electric moonroof and/or opening and closing an electric window. Second switch 130 need not be a toggle switch, as any switch known in the art will suffice. Non-limiting examples of alternate applicable second switches include push-button switches and selector switches. Moreover, embodiments of portable control unit 100 need not include second switch 130, as embodiments of portable control unit 100 may solely include first switch 120.

Some embodiments of portable control unit 100 may further comprise third switch 140. Referring to FIG. 1, third switch 140 may be any switch disposed on the housing utilized to further control a panel within a panel assembly. FIG. 1 illustrates an embodiment of portable control unit 100 that includes third switch 140 that comprises a momentary push-button switch. Accordingly, a user may activate third switch 140 (e.g., depress third switch 140) to control movement of a panel within a panel assembly in a third direction. This third direction can be forward, backward, up and/or down. Embodiments utilizing third switch 140 may therefore be capable of opening, closing, tilting up and/or tilting down an electric moonroof and/or opening and closing an electric window. Third switch 140 need not be a momentary push-button switch, as any switch known in the art will suffice. Non-limiting examples of alternate applicable switches include toggle switches, trigger switches, selector switches and joystick switches. Embodiments of portable control unit 100 need not include third switch 140.

Some embodiments of portable control unit 100 may further comprise fourth switch 150. Referring to FIG. 1, fourth switch 150 may be any switch disposed on the housing utilized to further control a panel within a panel assembly. FIG. 1 illustrates an embodiment of portable control unit 100 that includes fourth switch 150 that comprises a momentary push-button switch. Accordingly, a user may activate fourth switch 150 (e.g., depress fourth switch 150) to control movement of a panel within a panel assembly in a fourth direction. This fourth direction can be forward, backward, up and/or down. Embodiments utilizing fourth switch 150 may therefore be capable of opening, closing, tilting up and/or tilting down an electric moonroof and/or opening and closing an electric window. Fourth switch 150 need not be a push-button switch, as any switch known in the art will suffice. Non-limiting examples of alternate applicable switches include toggle switches, trigger switches, selector switches and joystick switches. Embodiments of portable control unit 100 need not include fourth switch 150.

Figure 2:
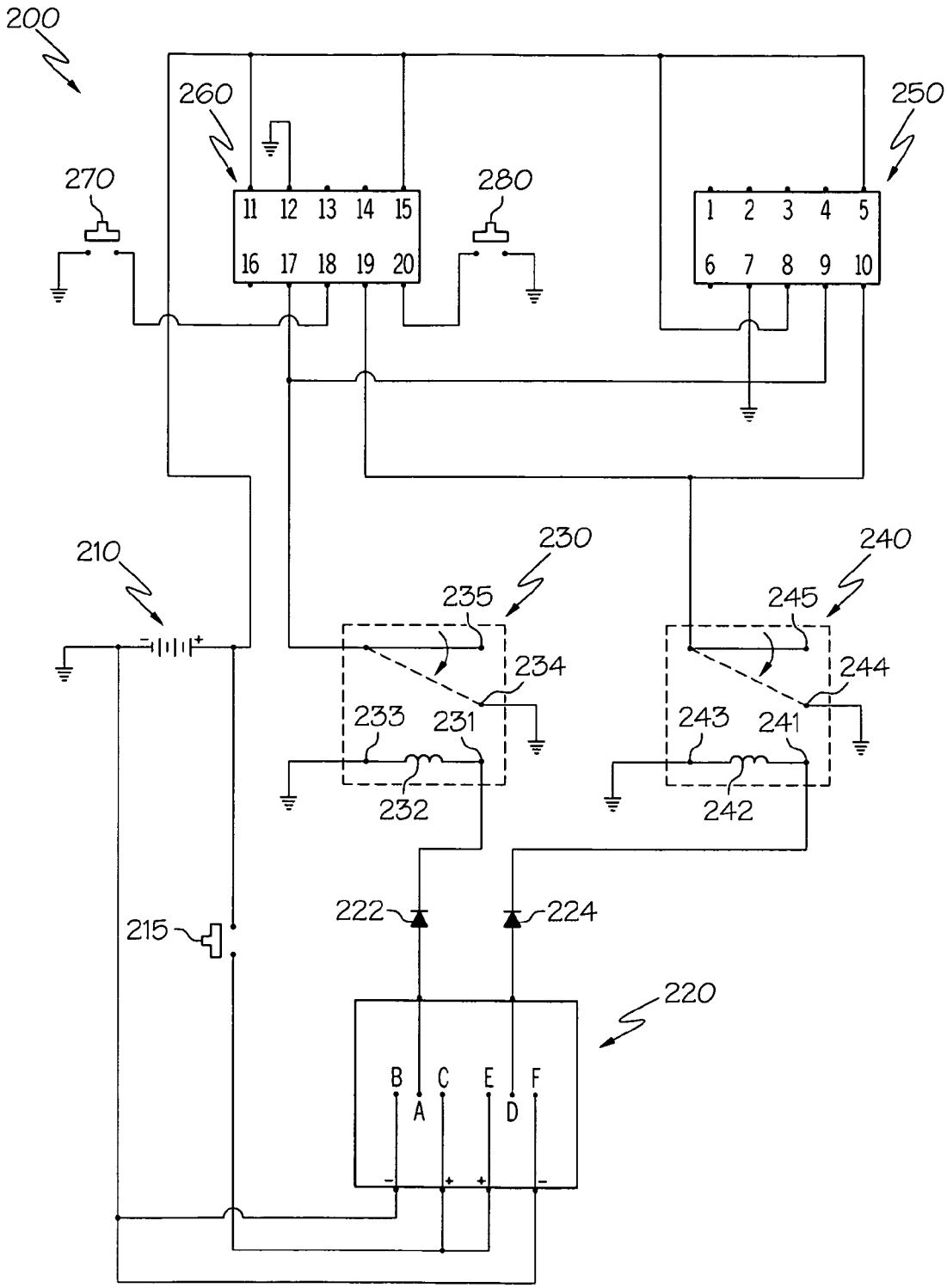
FIG. 2 is an electrical schematic of an exemplary portable control unit according to the embodiment of FIG. 1.

An electrical schematic 200 of FIG. 2 illustrates one electrical configuration of the embodiment of portable control unit 100 shown in FIG. 1. Although only electrical schematic 200 is shown, many other various electrical configurations have application to the illustrated embodiment of portable control unit 100. As illustrated in FIG. 2, through utilization of connectors 250,260 (depicted as 160,165 in FIG. 1), battery 210 (depicted as 180 in FIG. 1) of the portable control unit may be electrically connected to a panel assembly of a vehicle that lacks a power source. As described in detail below, a combination of switches, diodes and relays allows a user to control the movement of a panel within the panel assembly. In electric moonroof and/or electric window applications, a user can control the operation of an electric moonroof motor and/or an electric window motor that drives movement of the an electric moonroof and/or an electric window.

In one exemplary application of portable control unit 100, first connector (depicted as 160 in FIG. 1 and 250 in FIG. 2) is connected to a receptor of an electric moonroof motor (not shown). Referring to FIG. 2, controlling the electric moonroof motor to open the moonroof in such an application may be accomplished by the following process which mimics the moonroof "open" switch on a fully built vehicle. As illustrated in electrical schematic 200, battery 210 constantly supplies voltage to pins 5 and 8 of first connector 250. Opening the moonroof requires second switch 220 (depicted as 130 in FIG. 1) to be in a first orientation (i.e., terminal A contacts terminal C, and terminal D contacts terminal F). With second switch 220 in a first orientation, when a user activates first switch 215 (depicted as 120 in FIG. 1), battery 210 supplies voltage through open diode 222. With second switch 220 in this first orientation, voltage is also blocked from traveling back through close diode 224, because close diode 224 is reverse-biased. Voltage travels through open diode 222 to pin 231 of open relay 230. Voltage then travels from pin 231, through coil 232, to pin 233, which is connected to ground. The voltage traveling through coil 232 creates a magnetic field which trips open relay 230. When open relay 230 is tripped, pin 234, which is connected to ground, is contacted by pin 235. Ground is therefore applied from pin 234 to pin 235 to pin 9 of first connector 250. Applying ground to pin 9 of first connector 250 completes an electrical circuit and causes the moonroof motor to operate in a first direction (backward), thus opening the moonroof. In other embodiments, causing the moonroof motor to operate in a first direction can open the moonroof, as well as tilt the moonroof in a downward direction.

Still referring to FIG. 2, controlling the electric moonroof motor to close the moonroof in an application utilizing first connector 250 may be accomplished by the following process which mimics the moonroof "close" switch on a fully built vehicle. As illustrated in electrical schematic 200, battery 210 constantly supplies voltage to pins 5 and 8 of first connector 250. Closing the moonroof requires second switch 220 to be in a second orientation (i.e., terminal A contacts terminal B, and terminal D contacts terminal E). With second switch 220 in a second orientation, when a user activates first switch 215, battery 210 supplies voltage through close diode 224. With second switch in this second orientation, voltage is also blocked from traveling back through open diode 222, because open diode 222 is reverse-biased. Voltage travels through close diode 224 to pin 241 of close relay 240. Voltage then travels from pin 241, through coil 242, to pin 243, which is connected to ground. The voltage traveling through coil 242 creates a magnetic field which trips close relay 240. When close relay 240 is tripped, pin 244, which is connected to ground, is contacted by pin 245. Ground is therefore applied from pin 244 to pin 245 to pin 10 of first connector 250. Applying ground to pin 10 of first connector 250 completes an electrical circuit, and causes the moonroof motor to operate in a second direction (forward), thus closing the moonroof. In other embodiments, causing the moonroof motor to operate in a second direction can close the moonroof, as well as tilt the moonroof in a upward direction.

In another exemplary application in which second connector 260 is connected to an electric moonroof motor, battery 210 constantly supplies voltage to pins 11 and 15 of second connector 260. Following a similar process as the above described applications utilizing first connector 250, when second switch 220 is in a first orientation and a user activates first switch 215, ground is applied to pin 17 of second connector 260. Applying ground to pin 17 of second connector 260 completes an electrical circuit, and causes the moonroof motor to operate in a first direction (backward), thus opening the moonroof. When second switch 220 is in a second orientation and a user activates first switch 215, ground is applied to pin 19 of second connector 260. Applying ground to pin 19 of second connector 260 completes an electrical circuit, and causes the moonroof motor to operate in a second direction (forward), thus closing the moonroof.

However, in applications utilizing second connector 260, third switch 270 (depicted as 140 in FIG. 1) and fourth switch 280 (depicted as 150 in FIG. 1) may also be utilized to further control operation of the moonroof motor. When a user activates third switch 270, ground is connected to pin 18. Applying ground to pin 18 of second connector 260 completes an electrical circuit, and controls the connected moonroof motor to operate in a third direction, thus tilting the moonroof in an upward direction. When a user activates fourth switch 280, ground is connected to pin 20. Applying ground to pin 20 of second connector 260 completes an electrical circuit, and controls the connected moonroof motor to operate in a fourth direction, thus tilting the moonroof in an downward direction. However, in alternate embodiments, activating third switch 270 and fourth switch 280 may control a connected moonroof motor to drive the moonroof in alternate directions.

While particular embodiments and aspects of the present invention have been illustrated and described herein, various other changes and modifications can be made without departing from the spirit and scope of the invention. Moreover, although various inventive aspects have been described herein, such aspects need not be utilized in combination. It is therefore intended that the appended claims cover all such changes and modifications that are within the scope of this invention.

What is claimed is:

1. A handheld portable control unit for activating a panel assembly of a vehicle comprising:

a housing, a first switch disposed on the housing, at least one connector, and a battery;

wherein the housing comprises a gripping area; and wherein the at least one connector is configured to engage a receptor of a panel assembly of a vehicle, the panel assembly lacking a power source, such that the battery provides power to the panel assembly and the first switch controls movement of a panel within the panel assembly.

2. The portable control unit of claim 1, wherein the at least one connector comprises a first connector and a second connector, the first connector configured to engage a first receptor of a panel assembly of a first vehicle, and the second connector configured to engage a second receptor of a panel assembly of a second vehicle.

3. The portable control unit of claim 1, wherein the portable control unit is hand-held.

4. The portable control unit of claim 1, wherein the battery is rechargeable.

5. The portable control unit of claim 4, wherein the battery is a9 volt battery or a 12 volt battery.

6. The portable control unit of claim 1, wherein the first switch is a trigger switch.

7. The portable control unit of claim 6, further comprising a second switch disposed on the housing that controls the function of the trigger switch.

8. The portable control unit of claim 7, wherein the second switch toggles between a first orientation and a second orientation, wherein when the second switch is in a first orientation, activating the trigger switch controls the panel to move in a first direction, and when the second switch is in a second orientation, activating the trigger switch controls the panel to move in a second direction.

9. The portable control unit of claim 8, further comprising a third switch and a fourth switch disposed on the housing, wherein activating the third switch controls the panel to move in a third direction and activating the fourth switch controls the panel to move in a fourth direction.

10. A portable control unit for activating at least one of an electric moonroof and an electric window comprising:

a housing, a first switch disposed on the housing, at least one connector, at least one battery, and at least one wire connecting the at least one connector to the at least one battery;

wherein the at least one connector is capable of connecting the portable control unit to at least one of an electric moonroof motor and an electric window motor in a vehicle lacking a power source, such that the at least one battery provides power to the at least one of an electric moonroof motor and an electric window motor, and the first switch controls the at least one of an electric moonroof motor and an electric window motor.

11. The portable control unit of claim 10, wherein the at least one connector comprises a first connector and a second connector, the first connector capable of electrically connecting the portable control unit to at least one of an electric moonroof motor and an electric window motor of a first vehicle, and the second connector capable of electrically connecting the portable control unit to at least one of an electric moonroof motor and an electric window motor of a second vehicle.

12. The portable control unit of claim 10, wherein the at least one battery is rechargeable.

13. The portable control unit of claim 10, wherein the first switch is a trigger switch.

14. The portable control unit of claim 13, further comprising a second switch disposed on the housing that controls the function of the trigger switch.

15. The portable control unit of claim 14, wherein second switch toggles between a first orientation and a second orientation to control the function of the trigger switch, wherein when the second switch is in a first orientation, activating the trigger switch controls the at least one of an electric moonroof motor and an electric window motor to drive at least one of a moonroof and a window in a first direction, and when the second switch is in a second orientation, activating the trigger switch controls the at least one of an electric moonroof motor and an electric window motor to drive the at least one of a moonroof and a window in a second direction.

16. The portable control unit of claim 15, further comprising a third switch and a fourth switch disposed on the housing, wherein activating the third switch controls the at least one of an electric moonroof motor and an electric window motor to drive the at least one of a moonroof and a window in a third direction and activating the fourth switch controls the at least one of an electric moonroof motor and an electric window motor to drive the at least one of a moonroof and a window in a fourth direction.

17. A portable control unit for opening and closing at least one of an electric moonroof and an electric window comprising:

a housing, a trigger switch and a second switch disposed on the housing, at least one connector and at least one battery;

wherein the at least one connector is capable of connecting the portable control unit to at least one of an electric moonroof motor and an electric window motor in a vehicle lacking a power source, such that the at least one battery provides power to the at least one of an electric moonroof motor and an electric window motor, and the trigger switch controls the at least one of an electric moonroof motor and an electric window motor, and the at least one of an electric moonroof motor and an electric window motor drives at least one of a moonroof and a window;

wherein the second switch toggles between a first orientation and a second orientation to control the function of the trigger switch, wherein when the second switch is in a first orientation, activating the trigger switch controls the at least one of an electric moonroof motor and an electric window motor to drive the at least one of a moonroof and a window in a first direction, and when the second switch in a second orientation, activating the trigger switch controls the at least one of an electric moonroof motor and an electric window motor to drive the at least one of a moonroof and a window in a second direction.

18. The portable control unit of claim 17, further comprising a third switch and a fourth switch disposed on the housing, wherein activating the third switch controls the at least one of an electric moonroof motor and an electric window motor to drive the at least one of a moonroof and a window in a third direction, and activating the fourth switch controls the at least one of an electric moonroof motor and an electric window motor to drive the at least one of a moonroof and a window in a fourth direction.

19. The portable control unit of claim 17, wherein the at least one connector comprises a first connector and a second connector, the first connector capable of electrically connecting the portable control unit to at least one of an electric moonroof motor and an electric window motor of a first vehicle, and the second connector capable of electrically connecting the portable control unit to at least one of an electric moonroof motor and an electric window motor of a second vehicle.

20. The portable control unit of claim 17, wherein the battery is rechargeable.

* * * * *

UNITED STATES PATENT AND TRADEMARK OFFICE

CERTIFICATE OF CORRECTION

PATENT NO. : 8,080,745 B2
APPLICATION NO. : 12/341365
DATED : December 20, 2011
INVENTOR(S) : Smith It is certified that error appears in the above-identified patent and that said Letters Patent is hereby corrected as shown below:

Column 7, line 30, change “a9 volt” to “a 9 volt”.

Signed and Sealed this
Seventh Day of February, 2012

David J. Kappos

David J. Kappos
*Director of the United States Patent and Trademark Office*